United States Patent [19]

Chicoine

[11] Patent Number: 4,919,227

[45] Date of Patent: Apr. 24, 1990

[54] TAMPER RESISTANT SPEAKER GRILLE FOR INTERCOM MODULE

[75] Inventor: Troy R. Chicoine, New Britain, Conn.

[73] Assignee: Oits Elevator Company, Farmington, Conn.

[21] Appl. No.: 363,002

[22] Filed: Jun. 8, 1989

[51] Int. Cl.[5] ..... G10K 11/00

[52] U.S. Cl. ..... 181/175; 181/150

[58] Field of Search ..... 181/148, 150, 175, 199

[56] References Cited

U.S. PATENT DOCUMENTS

| | | | |
|---|---|---|---|
| 3,909,530 | 9/1975 | Gosswiller | 181/175 X |
| 3,989,909 | 11/1976 | Hodsdon et al. | 181/175 X |
| 4,832,150 | 5/1989 | Juset et al. | 181/175 |

*Primary Examiner*—Benjamin R. Fuller
*Attorney, Agent, or Firm*—William W. Jones

[57] ABSTRACT

A speaker grille is provided which protects the speaker diaphragm from tampering or vandalism. Speakers which are used in public places for intercoms, message transmission, voice synthesis instructions, or the like will be covered by the speaker grille which has two sets of misaligned sound transmitting apertures, which will allow sound to emanate from the speaker, but will prevent objects from being pushed through the grille apertures to the diaphragm. Each set of apertures is found in a separate grille component, and the components are then assembled to form the improved grill. The construction of the grilled assembly is such that it will resist most attempts to break it with commonly carried items.

7 Claims, 3 Drawing Sheets

TAMPER RESISTANT SPEAKER GRILLE FOR INTERCOM MODULE

DESCRIPTION

1. Technical Field

This invention relates to an improved grille for covering an audio speaker so as to protect the speaker diaphragm as well as the grille itself against damage by vandals.

2. Background Art

Speaker grilles used on audio speakers in public places such as public buildings, apartments, elevators and the like are exposed to mischief or vandalism, in that they can be easily broken by common items such as pens, keys, fingernail files, or the like. Thus, the speaker diaphragm behind the grille is subjected to damage. The diaphragm can also be damaged by pushing a small object such as a paper clip through the holes in the grille whereby holes can be poked in the speaker diaphragm.

3. Disclosure of the Invention

This invention relates to an improved speaker grille for use in a publicly accessible audio speaker assembly, which grille has increased strength to resist breakage, and has a plurality of sound transmitting apertures wherein which cannot be penetrated by objects such as paper clips, or the like. The grille is formed from two basic components each of which is provided with a matrix of holes which pass sound from the speaker diaphragm to ambient surroundings. One component is a cover which forms the outer face of the grille which is visible to the public, and the other component is an insert which interfits with the cover. Both the cover and the insert are provided with a matrix of holes for sound passage through the grille, but the holes in the cover are laterally offset from the holes in the insert. The misalignment of the holes in the two components does not hinder sound transmission, but it does prevent a slender object from being pushed through the grille holes to the diaphragm. The grille parts are preferably formed from an unfilled polycarbonate plastic sold under the trademark GE 940 Lexan by G.E. Plastics.

It is therefore an object of this invention to provide an improved speaker grille for use with publicly accessible audio speakers.

It is a further object of this invention to provide a grille of the character described which clearly transmits sound through a plurality of grille holes, but which protects the speaker diaphragm against slender objects being pushed through the grill holes.

It is an additional object of this invention to provide a grille of the character described which is formed from at least two separate but interconnected components, each of which is provided with a matrix of sound transferring holes, with the holes in one component being nonaligned with the holes in the next adjacent component.

These and other objects and advantages of the invention will become more readily apparent to those skilled in the art from the following detailed description of a preferred embodiment of the invention when taken in conjunction with the accompanying drawings, in which:

BEST MODE FOR CARRYING OUT THE INVENTION

Figure 2:
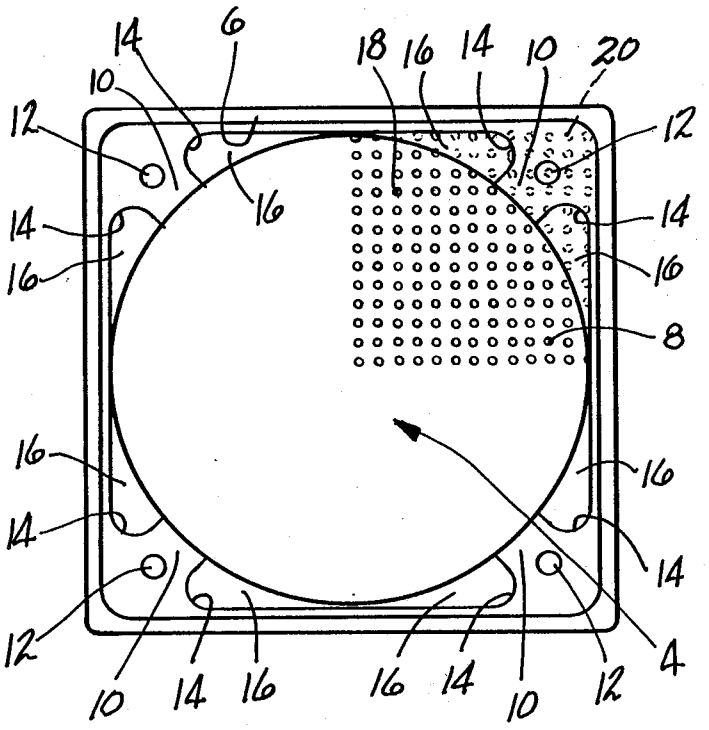
FIG. 2 is a back elevational view of the grille cover.
Figure 1:
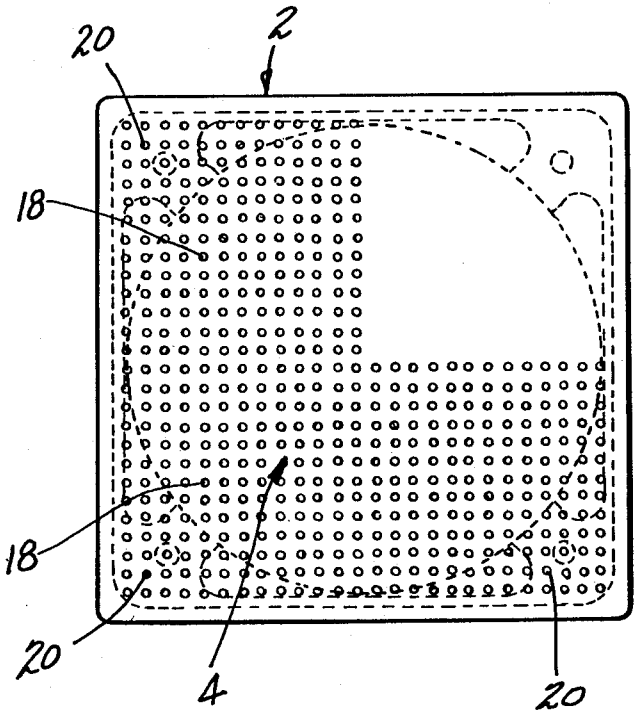
FIG. 1 is a front elevational view of the cover component of the grille assembly of this invention.

Referring now to FIGS. 1 and 2, the grille cover component designated generally by the numeral 2, is shown. FIG. 1 shows the front side of the cover 2, i.e. the side which can be seen by the public. The cover 2 has a central web part 4, and a peripheral boss 6 formed on the back side of the cover 2. A circular recess 8 is formed in the boss 6, which recess 8 is closed by the web 4. At each corner of the cover 2 on the back side there is formed a lug 10 containing a threaded assembly bore 12 for reception of assembly screws. The lugs 10 are flanked by arcuate recesses 14 having a bottom wall 16 which is offset upwardly from the back side of the central web 4. The central web 4 is provided with a matrix of through holes 18 for transmission of sound through the cover 2. The holes 20 which overlie the lugs 10 and recess walls 16 are blind bores only visible from the front of the cover 2, and do not transmit sound to any extent.

Figure 4:
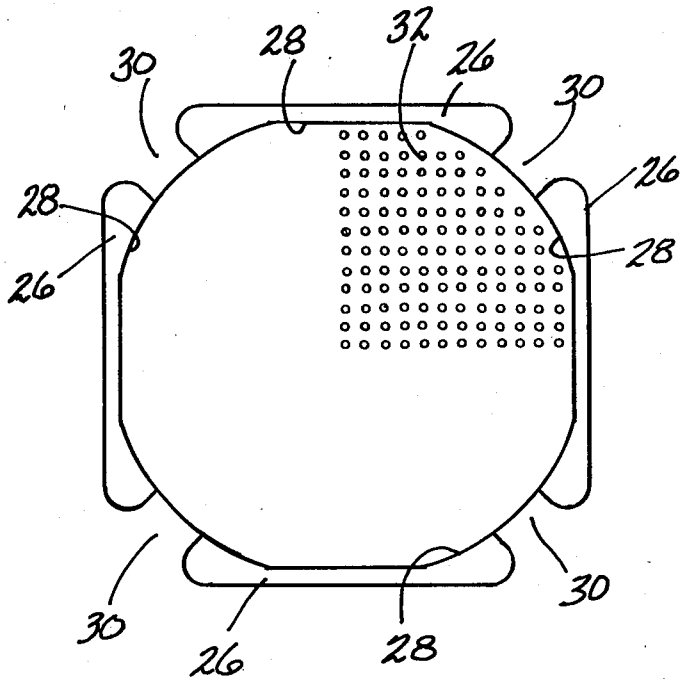
FIG. 4 is a back elevational view of the grille insert.
Figure 3:
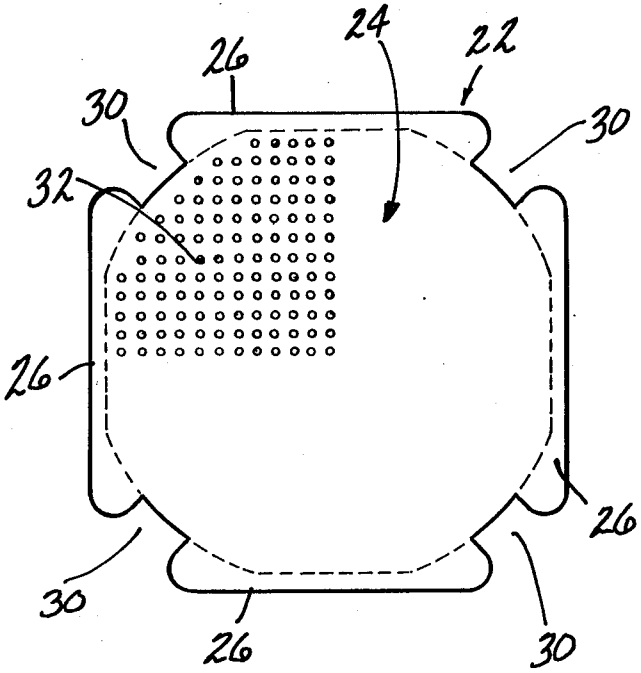
FIG. 3 is a front elevational view of the insert component of the grille assembly of this invention.

FIGS. 3 and 4 show details on an insert component denoted generally by the numeral 22 which interfits with the cover 2. The insert 22 includes a central web part 24, and four peripheral locating tabs 26 equally spaced about the web 24. The back sides of the tabs 26 project away from the web 24, as shown in FIG. 4 at 28, so that equally spaced gaps 30 are interposed between the tabs 26. The web 24 is provided with a matrix of holes 32, which, when the grille is assembled will be laterally offset from the holes 18 in the cover 2. Thus none of the holes 18 and 32 are aligned in the assembled grille.

Figure 6:
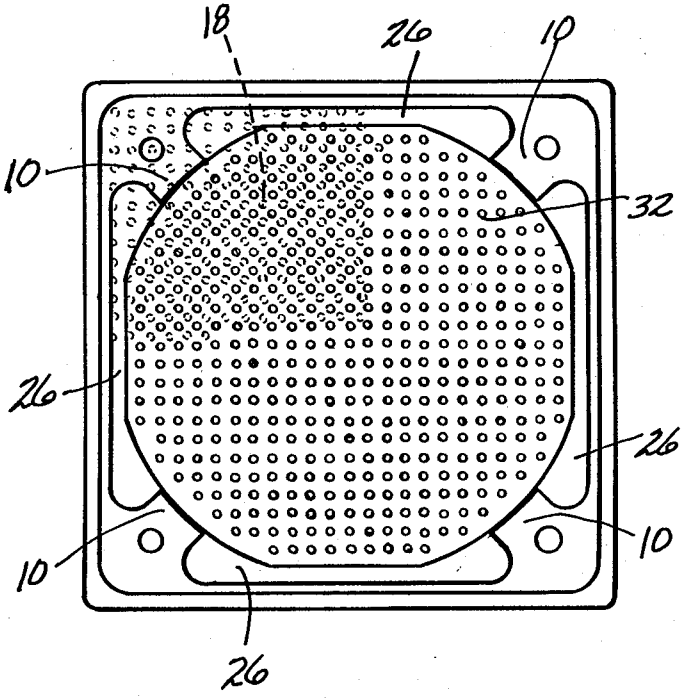
FIG. 6 is a back elevational view of the grille assembly.
Figure 5:
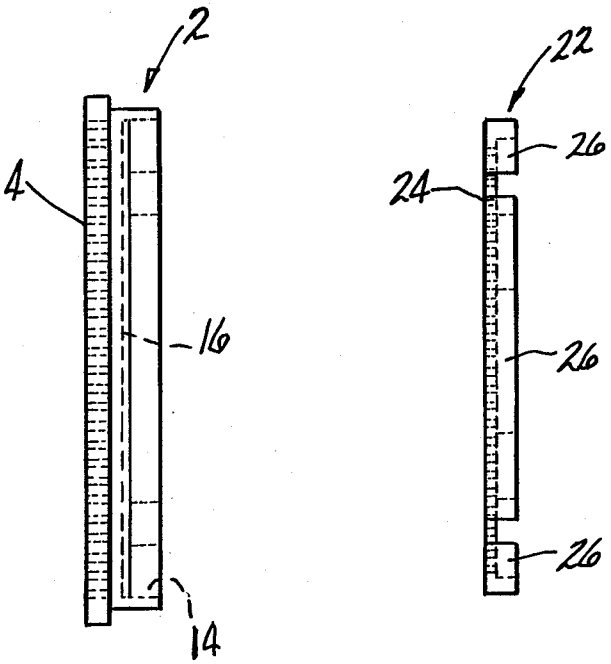
FIG. 5 is an exploded side elevational view of the grille assembly.

FIGS. 5 and 6 illustrate the assembled grille, wherein the insert 22 is fitted into the cover 2. As seen in FIG. 5, the insert web 24 faces the cover web 4, but is spaced apart therefrom by the tabs 26 nesting in the recesses 14 in contact with the bottom walls 16 thereof. As seen in FIG. 6, the interfit between the cover lugs 10 and the insert tabs 26 ensures that the insert holes 32 and the cover holes 18 are always misaligned irrespective of rotational orientation between the cover 2 and the insert 22. The upper left hand quadrant of FIG. 6 shows the misalignment between the two matrices of sound transmitting holes.

By using small diameter holes as described above, spaced greater than one diameter apart, and by using a web thickness which is greater than about three diameters, the grille will be strong enough to resist most attempts to break it using commonly carried items such as nail files, keys, pens, or the like. The assembly is such that adequate sound transmission is achieved with maximum speaker diaphragm protection. Assembly is simple since no particular part orientation is required.

Since many changes and variations of the disclosed embodiment of the invention may be made without departing from the inventive concept, it is not intended to limit the invention otherwise than as required by the appended claims.

What is claimed is:

1. A tamper-resistant speaker grille assembly comprising:

(a) a cover member which fronts ambient surroundings of the grille assembly, said cover member being provided with a plurality of small sound transmitting holes therein;

(b) an insert member juxtaposed to said cover member, and telescoped into a recessed area in said cover member, said insert member being provided with a plurality of additional small sound transmitting holes, wherein none of the sound transmitting holes in the cover member are coaxial with any of the sound transmitting holes in the insert ; and (c) a plurality of lug means equiangularly spaced about said cover member recessed area, and a plurality of locating tab means equiangularly spaced about a periphery of said insert member, said tab means being operable to engage any of said lug means to secure said insert member against angular rotation in said cover member recessed area, and said insert member being thus securable in said cover member recessed area in a plurality of different angular orientations to simplify assemblage of said grille assembly.

2. The speaker grille assembly of claim 1 wherein said cover member and said insert member are each formed with central opposed webs in which said respective sound transmitting holes are disposed, and wherein said lug and said tabs are formed peripherally of said webs.

3. The speaker grille assembly of claim 2 wherein said sound transmitting holes are formed in a grid pattern in the webs in said cover member and insert member, with each sound transmitting hole in each grid pattern being substantially equally spaced apart from the next adjacent holes and separated therefrom by intervening spans of said webs.

4. The speaker grille assembly of claim 3 wherein said intervening spans are greater than about one hole diameter in length, and said webs are greater than about three hole diameters in thickness.

5. The speaker grille assembly of claim 4 wherein there are four of said lugs on said cover member equispaced about said web, and there are four pairs of equispaced tabs on said insert member operable to hold said insert member against rotation in said cover member by engagement of each of said lugs by a corresponding pair of said tabs.

6. A tamper-resistant speaker grille assembly comprising:

(a) a cover member having a front side which faces ambient surroundings of the grille assembly, said cover member having a central web portion; a peripheral boss formed on a back side thereof; a plurality of equispaced lugs between said boss and said web, said lugs being flanked by locking recesses; and said web portion including a matrix of evenly spaced sound transmitting holes therein, said holes being separated by intervening web material spans; and (b) an insert member telescoped into said cover member so as to be surrounded outwardly by said peripheral boss, said insert member including a plurality of equispaced pairs of locking tabs disposed in said locking recesses and flanking said locking lugs to hold said insert member against rotational movement with respect to said cover member; and said insert member having a central web part facing said cover member web portion and including a matrix of evenly spaced sound transmitting holes separated by intervening web material spans, said insert member holes and said cover member holes being offset from each other so that each insert member hole faces a covering member web material span, and each cover member hole faces an insert member web material span whereby none of the cover member holes are aligned with any of the insert member holes, and wall means on said cover member for engagement by said locking tabs to hold said web portion and said web part spaced apart from each other to enhance sound transmission through said sound transmitting holes.

7. The speaker grille assembly of claim 6 wherein said web material spans are greater in length than about one hole diameter, and said webs are greater than about three hole diameters in thickness.

* * * * *